United States Patent [19]

Slayton et al.

[11] 3,986,543

[45] Oct. 19, 1976

[54] ROTARY CUTTER KNIFE

[75] Inventors: J. Richard Slayton; Paul Douglas Nalley, both of Jasper, Ind.

[73] Assignee: Kimball International, Inc., Jasper, Ind.

[22] Filed: July 21, 1975

[21] Appl. No.: 597,517

[52] U.S. Cl. ..... 144/236; 76/101 A; 29/105 R; 29/104; 90/11 B; 144/237

[51] Int. Cl.[2] ..... B27G 13/12

[58] Field of Search ..... 144/231, 236, 237; 76/101 A; 90/11 B; 29/105 R, 104

[56] References Cited

UNITED STATES PATENTS

| | | | |
|---|---|---|---|
| 321,828 | 7/1885 | Loar | 144/236 |
| 3,082,802 | 3/1963 | Dickson et al. | 144/237 |
| 3,237,275 | 3/1966 | Middleton | 144/237 |
| 3,491,422 | 1/1970 | Kelly et al. | 76/101 A |

*Primary Examiner*—Donald R. Schran
*Attorney, Agent, or Firm*—Melvin A. Crosby

[57] ABSTRACT

A rotary cutter knife in which a body is provided which is made up of coaxial discs in adjacent relation. Each disc has cutting edge portions distributed about the periphery thereof and in one relatively rotated position of the discs the cutting edge portions align in the axial direction thereby positioning the cutting edge portions for easy sharpening. In another rotated position of the discs, the cutting edge portions are staggered and the cutting load on the cutter knife is thereby distributed circumferentially during working operations of the cutter knife. Cooperating elements of keying means are provided for keying the discs in the two relatively rotated positions thereof.

8 Claims, 5 Drawing Figures

ROTARY CUTTER KNIFE

The present invention relates to a rotary cutter knife, especially a cutter knife for forming contours on work members such as wood and the like.

Rotary cutter knives are often employed for cutting wood work members and the like, especially to impart contours thereto, for example, for furniture making. Heretofore, such cutter knives have been made by forming a generally cylindrical body with one or more axially extending cutting edges on the periphery thereof with the body being contoured to impart the desired profile to the work member to be cut. With such cutter knives the cutting load imposed on the cutter knife during working operations is distributed only to the extent that the individual cutting edges are distributed around the body. The load imposed on the cutter knife is thus somewhat variable during working operations and this not only creates a noisy condition but imparts shocks to the knife supporting structure and the drive motor therefor and can even cause movement of the piece being cut which will detract from the accuracy of the cutting operation.

The primary object of the present invention is to provide a rotary cutter knife in which the drawbacks referred to above are greatly reduced, or entirely eliminated.

Another object of the present invention is the provision of a rotary cutter knife in which the body is axially segmented so that the cutting edge is in the form of individual portions on the disc-like segments of the cutter body and can be aligned for sharpening while the segments can be adjusted to place the respective cutting edge portions in staggered relation, thereby providing for distributed load conditions during a cutting operation.

BRIEF SUMMARY OF THE INVENTION

According to the present invention, a body is provided for a rotary cutting knife, especially a rotary cutting knife for wood and the like, and in which the body is segmented in the axial direction so that it is made up of a plurality of adjacent coaxially arranged discs. The cutter body is axially grooved and on the forwardly facing side of each groove there is mounted a hard wear resistant cutting insert so that cutting edges are formed along the radially outer edges of the forwardly facing sides of the respective grooves. The several discs into which the cutter body is divided are arranged for being keyed together in a first relatively rotated position in which the cutting edges on the body extend axially therealong, whereby sharpening of the cutting edges is greatly simplified. The discs can also be keyed together in a second relatively rotated position in which the individual portions of the cutting edges on the respective discs are staggered in the circumferential direction thereby spreading out the cutting load during rotation of the cutter body so that more constant and uniform cutting conditions can be had.

The exact nature of the present invention will become more apparent upon reference to the following detailed specification taken in connection with the accompanying drawings, in which.

DETAILED DESCRIPTION OF THE INVENTION

Figure 1:
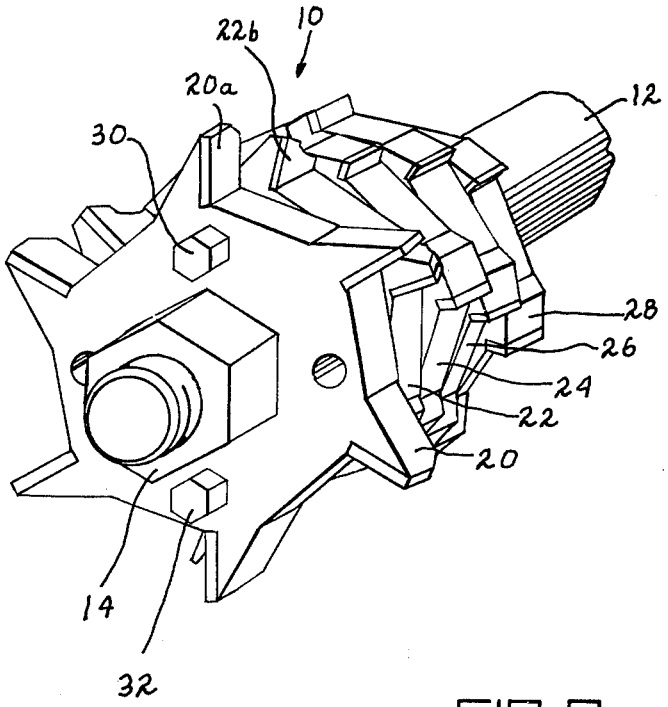
FIG. 1 is a perspective view showing one form in which a rotary cutter knife according to the present invention can take.
Figure 2:
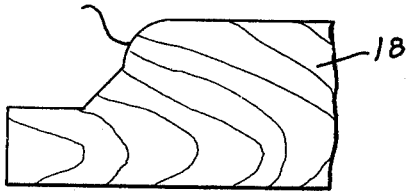
FIG. 2 is a fragmentary sectional view showing a typical work piece which might be contoured by the cutter knife of FIG. 1.

Referring to the drawings somewhat more in detail, in FIG. 1 a cutter knife body generally indicated at 10 is provided and has a central hole so as to be adapted for mounting on a support and drive shaft 12 and clamped in place by a nut 14 on the end of the shaft. The cutter knife body is profiled and is adapted, for example, to impart a profile, such as indicated at 16 in FIG. 2, to a workpiece 18 which may, for example, be wood.

According to the present invention, the body 10 is segmented in the axial direction, thereby to take the form of a plurality of adjacent discs 20, 22, 24, 26 and 28. Each disc has uniformly distributed thereabout respective portions of the cutting edges of the cutter body. In FIG. 1, for example, the cutter body has six cutting edges distributed uniformly circumferentially thereabout and each of the discs has a respective portion of each cutting edge thereon. For example, in FIG. 1, **20*a* represents the respective portion of one of the cutting edges which is carried by disc 20 and 22*b* indicates the corresponding portion of the same cutting edge that is carried by disc 22** and so on for the others of the discs making up the body.

As will be seen in FIG. 1, the respective portions of each cutting edge on the discs are staggered uniformly in the circumferential direction and this is the position which the discs occupy during a cutting operation. With the discs arranged as shown in FIG. 1, the cutting load is distributed uniformly during rotation of the cutter thereby avoiding shocks and nonuniform loads and resulting in quieter operation and a smoother finish.

However, the sharpening of the cutter knife with the individual discs in the position illustrated in FIG. 1 would be extremely difficult and, accordingly, the present invention provides for movement of the discs relatively into another rotated position in which the individual portions of each cutting edge on the respective discs aligns in the axial direction. This presents the cutting edges in such a manner that it is quite simple to sharpen the cutting edges in a conventional manner.

Figure 3:
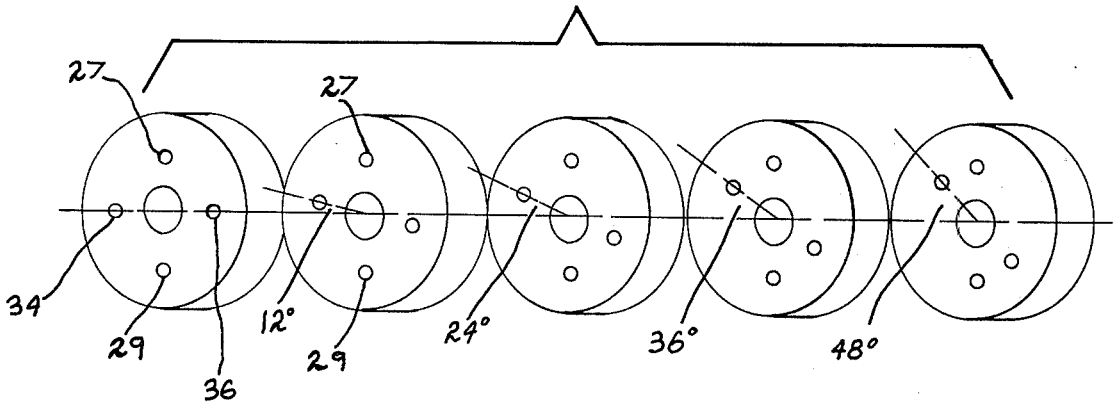
FIG. 3 is a schematic perspective view showing the arrangement of key elements of respective discs of the cutter knife.

The discs, as will be seen in FIG. 3, have formed therein a first set of holes at 27 and 29 which align when the discs are in the FIG. 1 position thereof and through which holes 27 and 29 bolts 30 and 32 can be placed to key the discs together in the FIG. 1 position and to hold the discs firmly in the FIG. 1 position during cutting operations.

As will be evident from FIG. 1, which shows five discs and six cutting edges on the cutter knife body, relative movement between adjacent discs of twelve degrees from the working position thereof will bring the respective cutting edge portions thereof into axial alignment to present the cutting edges in the best position for sharpening.

According to the present invention this is accomplished quite simply by providing each of the discs with a second set of holes 34 and 36 in FIG. 3, which, it will be seen, are successively spaced twelve degrees from the corresponding second set of holes in adjacent ones of the discs. Thus, by loosening nut 14 and withdrawing bolts 30 and 32 from holes 27 and 29 and by then relatively moving the discs on shaft 12 until the respective cutting portions thereon are in alignment, and then reinserting bolts 30 and 32 in the second set of holes 34 and 36 provided in the discs and again tightening up nut 14, the discs of the cutter body will be arranged for a sharpening operation with the individual cutting edge portions in axial alignment.

Figure 4:
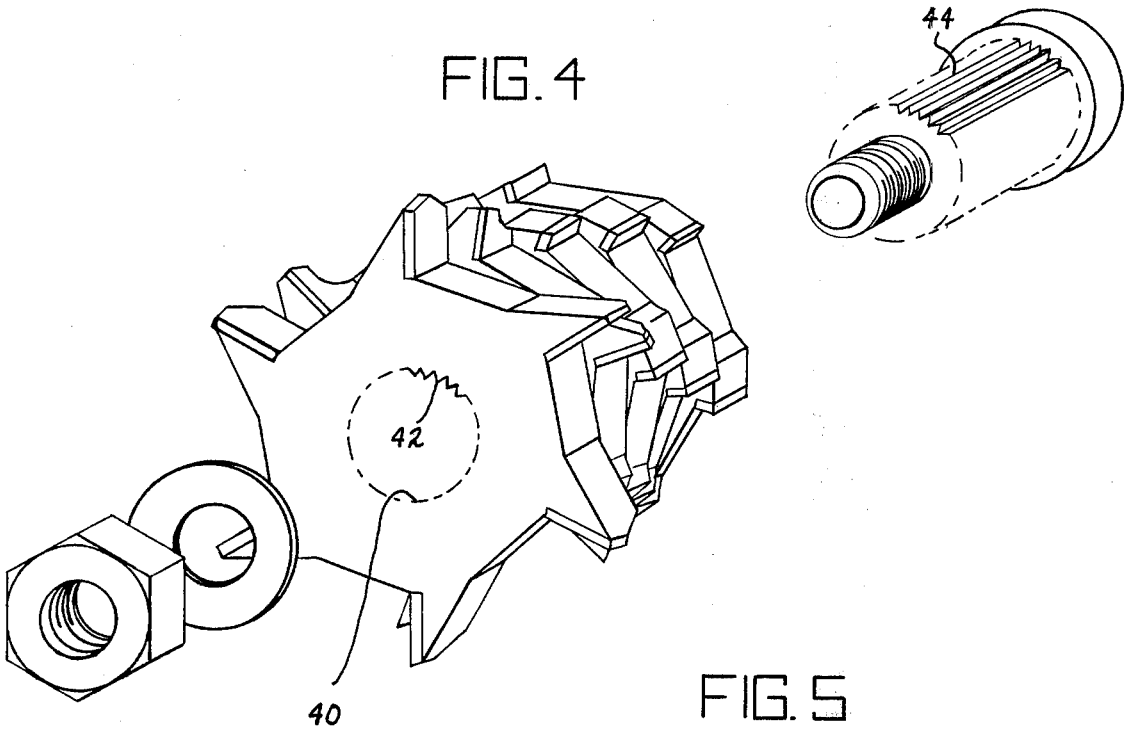
FIG. 4 is a perspective view showing a modified form which the cutter knife can take with the discs thereof adjusted into cutting, or working, position.
Figure 5:
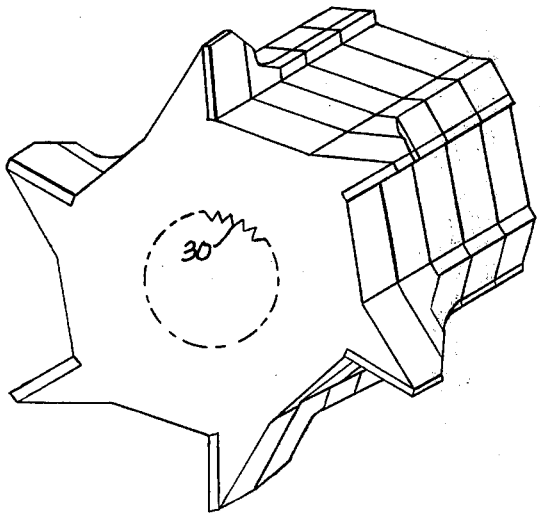
FIG. 5 is a perspective view of the arrangement of FIG. 4 showing the discs of the cutter knife aligned in sharpening position.

Turning now to FIGS. 4 and 5, these Figures show a rotary cutter knife the same as the one shown in FIG. 1 and bearing the same numbers except the discs in FIGS. 4 and 5 are not provided with the holes 27 and 29, 34 and 36 but, instead, the central hole 40 in each disc provided for receiving support and drive shaft 12 is provided with internal teeth 42 adapted for interfitting engagement with external teeth 44 formed on the drive shaft.

With each disc having six cutting edge portions thereon and with there being five discs, teeth 42 and 44 are at least 30 in number so that, for sharpening purposes, the discs can be withdrawn from shaft 12 and replaced thereon with each disc being rotated twelve degrees relative to the adjacent disc to place the cutting edges in axial alignment as is illustrated in FIG. 5.

From the foregoing it will be appreciated that the present invention discloses a novel cutter body in which both work and grinding operations are improved and also discloses a method of making a cutter knife in which the advantages are obtained that improved cutting conditions are established during work operations, while improved conditions can readily be established for sharpening operations to be performed on the cutting edges of the cutter knife.

It will be apparent that while the two different arrangements have been illustrated for supporting the several discs of the cutter knife in a first relatively rotated position for sharpening operations and in a second relatively rotated position for working operations, it is intended to comprehend within the purview of the present invention other such keying arrangements.

Modifications may be made within the scope of the appended claims.

What is claimed is:

1. In a rotary cutter knife having peripheral cutting edge means; a plurality of discs each having a respective portion of said cutting edge means formed on the periphery, means for supporting said discs in coaxial adjacent relation, means for positioning said discs in a first relatively rotated position in which said portions of said cutting edge means are aligned for sharpening all of said portions at the same time, and means for positioning said discs in a second relatively rotated position in which said portions of said cutting edge means are spaced in the circumferential direction of said cutter knife to distribute the cutting load when said cutter knife rotates in cutting relation to a workpiece.

2. A rotary cutter knife according to claim 1 in which said cutting edge means is nonlinear when viewed in the circumferential direction of said cutter knife.

3. A rotary cutter knife according to claim 1 in which each disc has a central aperture to receive a support and drive shaft, and means for keying said discs against relative rotation in each of said first and second rotated positions thereof.

4. A rotary cutter knife according to claim 1 to which each disc has a central aperture to receive a support and drive shaft, axial hole means formed in said discs radially outwardly from the central aperture in each disc, and rod elements receivable in said hole means in each of said first and second rotated positions of said discs to key the discs together in each said position.

5. A rotary cutter knife according to claim 1 in which each disc has a central aperture to receive a support and drive shaft, and teeth distributed about the periphery of each aperture engageable with teeth formed on the support and drive shaft for keying said discs to the shaft in each of said first and second rotated positions of said discs.

6. A rotary cutter knife according to claim 1 in which each cutting edge portion is formed by a peripheral notch in the respective disc and a hard wear resistant cutting insert fixed to the forwardly facing side of the notch.

7. A rotary cutter knife according to claim 1 in which said cutting edge means comprises a plurality of cutting edges which are spaced uniformly in the circumferential direction of said cutter knife when said discs are in said first rotated position thereof, each disc having a respective portion of each cutting edge formed thereon, said cutting edge portions on the respective discs being substantially uniformly spaced in the circumferential direction when said discs are in said second rotated position thereof.

8. A rotary cutter knife according to claim 7 in which adjacent discs are displaced relatively when the discs are changed from said first rotated position thereof to said second rotated position an angular amount about equal to 360° divided by the product of the number of discs and the number of cutting edges.

* * * * *